US005641189A

United States Patent [19]

Landman

[11] Patent Number: 5,641,189

[45] Date of Patent: Jun. 24, 1997

[54] MULTIPLE STRAP CARRIER

[75] Inventor: Charles W. Landman, Callao, Va.

[73] Assignee: The United States of America as represented by the Secretary of the Navy, Washington, D.C.

[21] Appl. No.: 562,548

[22] Filed: Nov. 17, 1995

[51] Int. Cl.[6] ..... B66C 1/12

[52] U.S. Cl. ..... 294/77; 294/74

[58] Field of Search ..... 294/74–77, 86.42, 294/150–152, 157, 165; 383/16, 117

[56] References Cited

U.S. PATENT DOCUMENTS

| | | | |
|---|---|---|---|
| 618,333 | 1/1899 | Colteryahn | 294/157 |
| 1,088,939 | 3/1914 | Snee | 294/77 |
| 2,268,598 | 1/1942 | Kellems | 294/86.42 |
| 3,765,711 | 10/1973 | Hammond | 294/77 |
| 3,923,222 | 12/1975 | Groves . | |
| 4,127,223 | 11/1978 | Uchin . | |
| 4,140,257 | 2/1979 | Peterson | 294/151 |
| 5,285,939 | 2/1994 | Hogan . | |
| 5,407,110 | 4/1995 | Marsh, Jr. | 224/148 |
| 5,549,342 | 8/1996 | Donaldson et al. | 294/77 |

*Primary Examiner*—Dean Kramer
*Attorney, Agent, or Firm*—James B. Bechtel, Esq.

[57] ABSTRACT

A multiple strap carrier includes a base with a first strap passing under the base and extending beyond the base to form a first extension and a second extension. The first extension has loops thereon spaced apart from one another. One or more second straps also pass under the base. The first strap and second strap(s) cross one another under the base. Each second strap also extends beyond the base to form a third extension and a fourth extension. The third and fourth extensions each have loops thereon spaced apart from one another. Each of a plurality of tightening straps are attached to the second extension of the first strap. Each tightening strap passes through one loop on each of the first, third and fourth extensions. The loops are positioned such that the tightening straps are substantially parallel to one another.

18 Claims, 3 Drawing Sheets

MULTIPLE STRAP CARRIER

ORIGIN OF THE INVENTION

The invention described herein was made in the performance of official duties by an employee of the Department of the Navy and may be manufactured, used, licensed by or for the Government for any governmental purpose without payment of any royalties thereon.

FILED OF THE INVENTION

The invention relates generally to carrier devices, and more particularly to a carrier made from multiple straps used to handle ordnance components of various sizes, shapes and weights.

BACKGROUND OF THE INVENTION

For safety, the military requires that any device used to carry or handle certain ordnance components, e.g., experimental test units, warheads, projectiles, etc., must pass rigorous test standards before being certified for use. Obviously, the carrier must function with such components in a safe manner. In addition, the device should be lightweight so as not to add unnecessary handling weight. The device should also be cost-effective in order to adhere to increasingly important budget restrictions. However, with the components existing in a variety of sizes, shapes and weights, a number of such handling devices have been designed to handle specific components. This increases not only manufacturing costs, but also testing costs since it costs thousands of dollars to certify each individual design.

SUMMARY OF THE INVENTION

Accordingly, it is an object of the present invention to provide a carrier design that can safely handle a variety of ordnance components of different sizes, shapes and weights.

Another object of the present invention is to provide a carrier for ordnance components that is lightweight.

Yet another object of the present invention is to provide a carrier for ordnance that is inexpensive to manufacture.

Other objects and advantages of the present invention will become more obvious hereinafter in the specification and drawings.

In accordance with the present invention, a carrier includes a base with a first strap passing under the base at a central portion thereof. The first strap extends beyond the base from diametrically opposed positions about the base to form a first extension and a second extension. The first extension includes a first plurality of loops spaced apart from one another. One or more second straps also pass under the base. The first strap and second straps cross one another under the base. Each second strap also extends beyond the base from diametrically opposed positions about the base to form a third extension and a fourth extension. The third extension includes a second plurality of loops spaced apart from one another. The fourth extension similarly includes a third plurality of loops spaced apart from one another. Each of a plurality of tightening straps are attached to the second extension of the first strap. Each tightening strap passes through one of the first plurality of loops, one of the second plurality of loops and one of the third plurality of loops. The first, second and third plurality of loops are positioned such that the tightening straps are substantially parallel to one another.

DETAILED DESCRIPTION OF THE INVENTION

Figure 1:
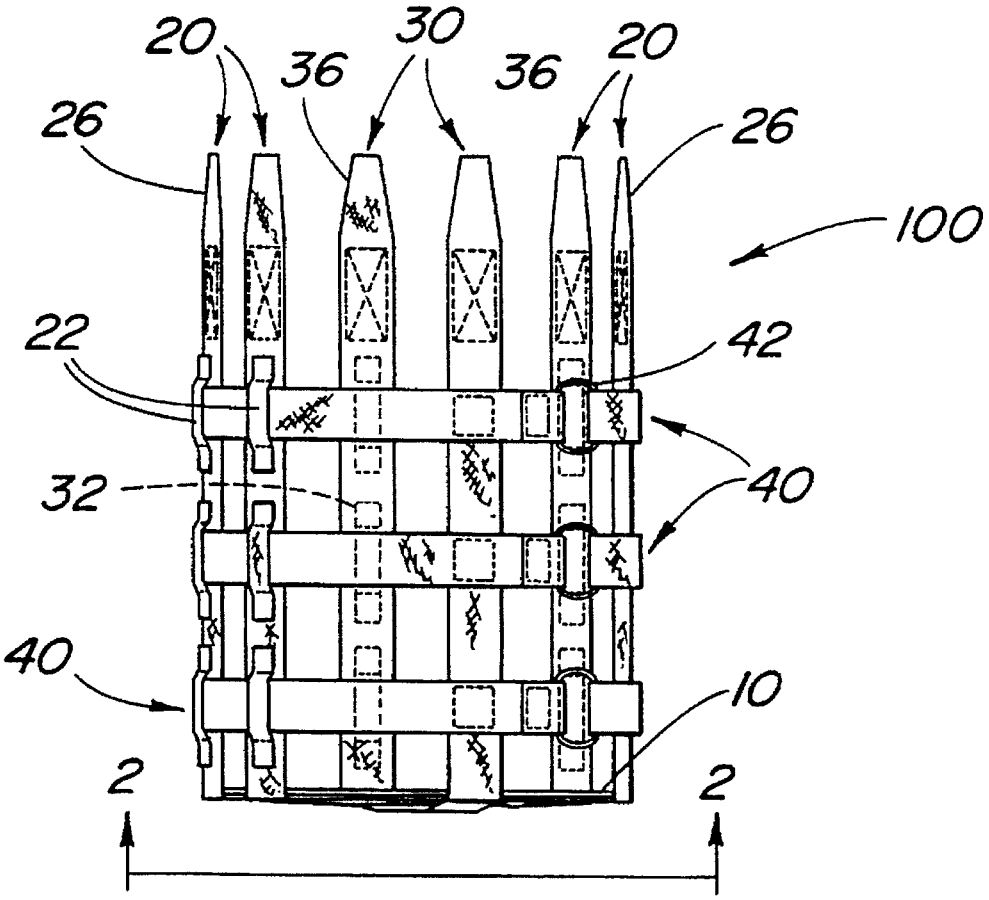
FIG. 1 is a side view of the multiple strap carrier assembled according to the present invention.
Figure 2:
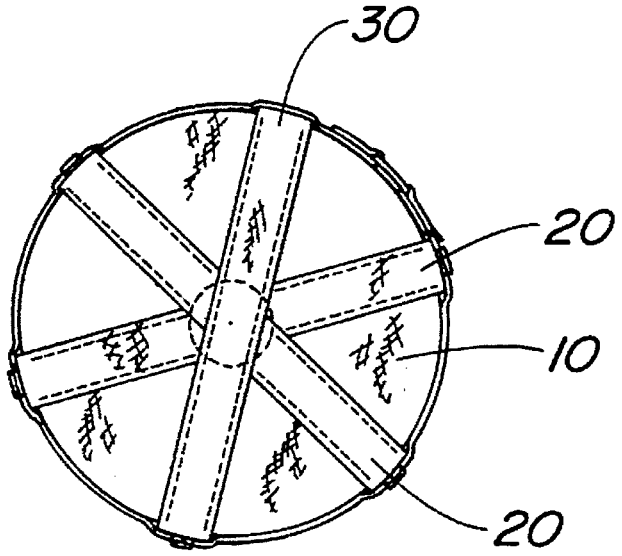
FIG. 2 is a bottom view of the multiple strap carrier taken along line 2—2 of FIG. 1.

Referring now to the drawings, and more particularly to FIGS. 1 and 2, the multiple strap carrier assembled in accordance with the present invention is shown in a side view in FIG. 1 and is referenced generally by numeral 100. The bottom view of carrier 100 is shown in FIG. 2 which represents a view of carrier 100 taken along line 2—2 of FIG. 1. Carrier 100 is particularly useful for handling a variety of ordnance components as will be explained herein by way of illustrative example. However, it is to be understood that the present invention is a simple, lightweight and strong carrier device suitable for handling or hoisting a wide variety of objects.

Carrier 100 is a flexible carrier that conforms to a variety of shapes. In terms of ordnance components, the materials used to construct carrier 100 are flexible, spark-resistant materials such as woven nylon webbing and nylon thread for the stitching thereof. These materials are preferable owing to their commercial availability, lightweight, strength and low-cost. However, other flexible spark-resistant materials such as leather could be used.

Carrier 100 includes base 10 which is typically round to allow base 10 to easily conform to the base of a component (not shown) when carrier 100 is hoisted upward. A number of straps are attached to base 10 and cooperate therewith to form carrier 100. More specifically, three different strap types are used by the present invention. The first of these strap types is shown in various views in FIGS. 3, 4 and 5 prior to being incorporated into the assembly that is carrier 100. The second and third of these strap types are shown in plan form in FIG. 6 prior to their incorporation into the assembly that is carrier 100.

Figure 3:
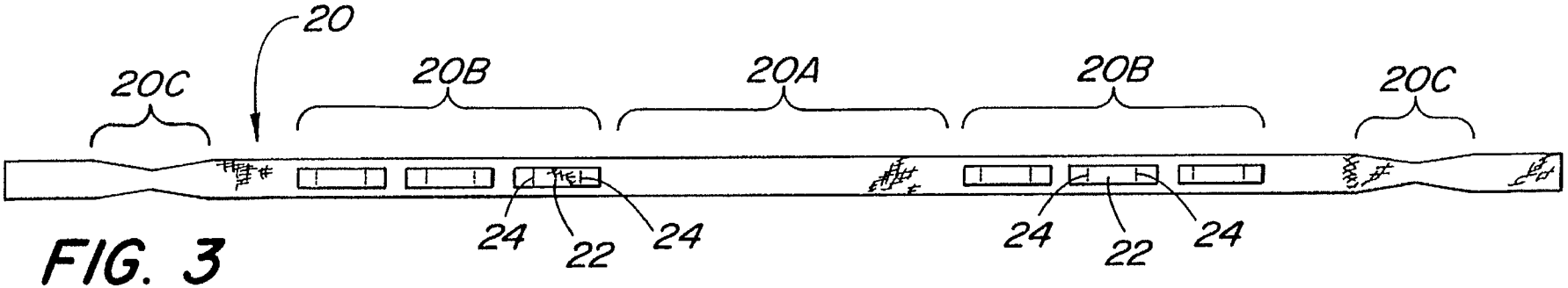
FIG. 3 is a plan view of one vertical strap having a plurality of belt loops formed thereon, and further showing the ends thereof prior to being stitched to form the hoisting loops.
Figure 4:
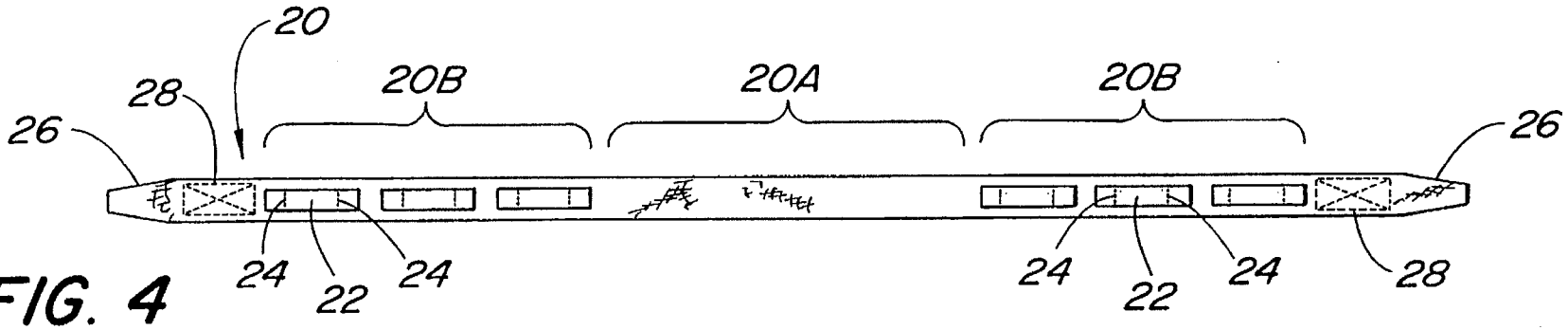
FIG. 4 is a plan view of the vertical strap of FIG. 3 after its ends have been stitched to form the hoisting loops.
Figure 5:
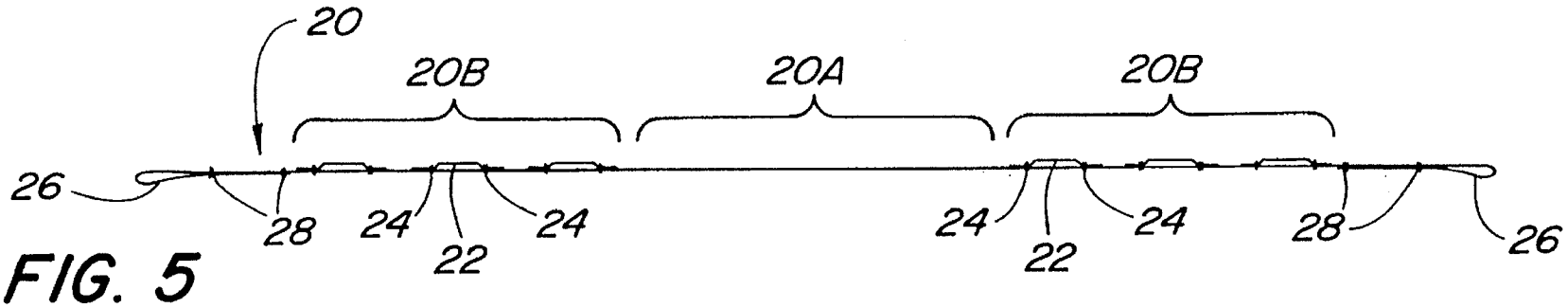
FIG. 5 is a side view of the vertical strap as taken along line 5—5 of FIG. 4.

Referring first to FIGS. 3, 4 and 5, like reference numerals will be used for common elements. Strap 20 includes central portion 20A that wraps under base 10 as best shown in FIG. 2. In the illustrated embodiment, two of straps 20 are used to make carrier 100. As will become apparent, at least one of straps 20 is required and two or more can be used. Each strap 20 has identical extension portions 20B that, in the plan view, extend outward from central portion 20A. In the assembled form of carrier 100, extension portions 20B extend upward from base 10. Formed on each extension portion 20B are a plurality (three are shown) of spaced-apart belt or strap loops which can be formed by stitching a piece of material 22 to strap 20 as indicated by dashed stitch lines 24. Strap 20 has reduced width portions 20C (FIG. 3) near either end thereof. Tapered hoisting loops 26 (FIGS. 4 and 5) are formed at either end of strap 20 when reduced width portion 20C is folded at its narrowest width and stitched as indicated by dashed stitch lines 28. Hoisting loops 26 are used to grasp carrier 100. The tapering of each hoisting loop 26 facilitates the positioning of loop 26 on a hoisting hook (not shown).

Figure 6:
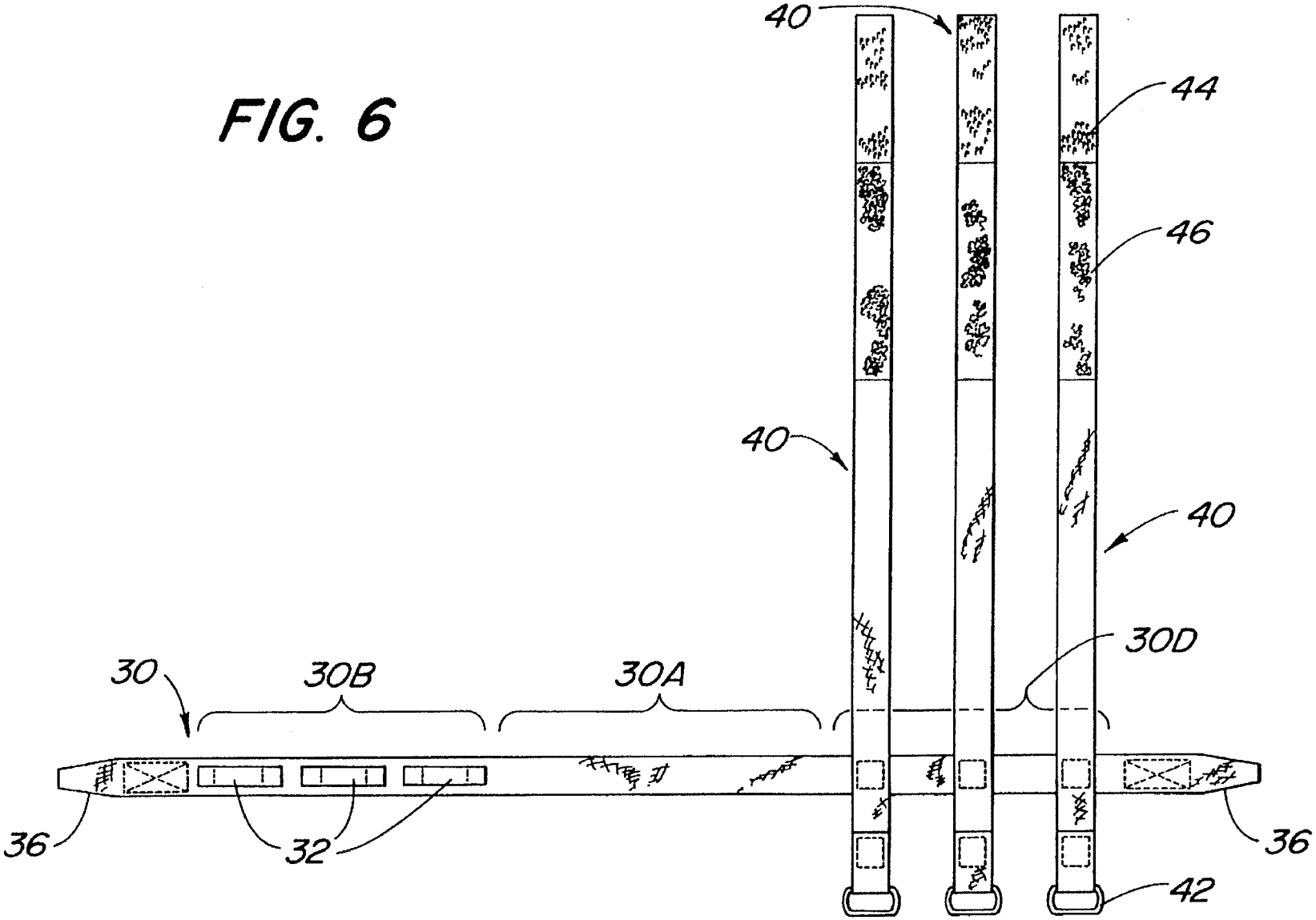
FIG. 6 is a plan view of a vertical strap with three horizontal straps attached thereto.

Referring now to FIG. 6, the second and third strap types will be described. The second strap type, or strap 30, has central portion 30A, extension portion 30B with a piece of material 32 stitched thereon to form strap loops, and reduced width portions (not shown) for forming tapered hoisting loops 36. Central portion 30A, extension portion 30B with pieces 32, and hoisting loops 36 are analogous to central portion 20A, extension portion 20B with pieces 22, and hoisting loops 26, respectively. Accordingly, the construction of these elements will not be described further herein.

The other extension portion of strap 30, designated extension portion 30D in FIG. 6, has a plurality of the third type of straps attached thereto in spaced-apart fashion. More specifically, straps 40 are attached near one end thereof to strap 30 along extension portion 30D. Three straps 40 are shown since three stop loops are formed on each of extension portions 20B and 30B. Generally, each of straps 40 is perpendicular to strap 30 and parallel to adjacent ones of straps 40. Spacing between the centers of each of straps 40 is commensurate with the spacing between the centers of the strap loops formed by pieces 32 and by pieces 22 on straps 20. As will become apparent, each of straps 40 cooperates with the strap loops formed by pieces 22 and 32 on straps 20 and 30, respectively. Further, straps 40 can be tightened about a component to be carried. Accordingly, each of straps 40 must be able to form an adjustable circumference loop or belt. One simple way of accomplishing this to provide ring 42 at one end of strap 40 and hook-and-loop fastening material, e.g., Velcro®, at the other or free end of strap 40. More specifically, outboard end portion 44 could be loop tape stitched to strap 40 while interior portion 46 could be hook tape stitched to strap 40.

To assemble carrier 100, strap 30 with a plurality of straps 40 and one or more of straps 20 is required along with base 10. Central portions 20A and 30A are crossed under and attached, e.g., stitched, to base 10 as best seen in FIG. 2. Typically, the angular spacing between each adjacent strap is identical for proper balance. For the example, in the illustrated embodiment, the angular spacing is 60°. However, if only one of straps 20 was to be used, the angular spacing would be 90°. Each of straps 20 and 30 extend beyond base 10. In this way, when straps 40 are fed through the strap loops on extension portions 20B and 30B and tightened (using ring 42 and the hook-and-loop fastening material), extension portions 20B, 30B and 30D are forced upright to form carrier 100 shown in FIG. 1. If the component to be handled is smaller that the diameter of base 10, the flexible nature of base 10 will conform to such smaller size when carrier 100 is lifted by hoisting loops 26 and 36. In addition, straps 40 can be tightened to reduce the diameter of carrier 100. This will prevent smaller components from being jostled during handling.

The advantages of the present invention are numerous. The carrier is simple to manufacture and use. It is adaptable to a variety of component sizes. In terms of military ordnance handling, this means that one carrier could be certified for a variety of ordnance components. Furthermore, the carrier can be easily stored in a flat position and quickly assembled about a component to be carried.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A carrier comprising:

a base;

a first strap passing under said base at a central portion thereof, said first strap extending beyond said base from diametrically opposed positions about said base to form a first extension and a second extension, said first extension including a first plurality of loops spaced apart from one another along said first extension;

at least one second strap passing under said base and crossing said central portion such that said first strap and said at least one second strap cross one another under said base, said at least one second strap extending beyond said base from diametrically opposed positions about said base to form a third extension and a fourth extension, said third extension including a second plurality of loops spaced apart from one another along said third extension, said fourth extension including a third plurality of loops spaced apart from one another along said fourth extension; and a plurality of tightening straps for forming a corresponding plurality of adjustable circumference loops, each of said plurality of tightening straps attached to said second extension and passing through one of said first plurality of loops, one of said second plurality of loops and one of said third plurality of loops.

2. A carrier as in claim 1 further comprising means for attaching said first strap and said at least one second strap to said base at said central portion thereof.

3. A carrier as in claim 1 wherein said first strap and said at least one second strap cross one another to define equiangular spacing therebetween.

4. A carrier as in claim 1 wherein said at least one second strap comprises a plurality of second straps.

5. A carrier as in claim 1 wherein said at least one second strap comprises two second straps.

6. A carrier as in claim 1 wherein said first plurality of loops, said second plurality of loops and said third plurality of loops are aligned to define a corresponding plurality of loop arrangements, each of said plurality of loop arrangements cooperating with one of said plurality of tightening straps.

7. A carrier as in claim 1 wherein said first plurality of loops, said second plurality of loops and said third plurality of loops are positioned such that said plurality of tightening straps are substantially parallel to one another.

8. A carrier as in claim 1 wherein said base is flexible.

9. A carrier as in claim 1 wherein said base is round.

10. A carrier comprising:

a round base;

a first strap attached to said round base and having a first extension and a second extension extending beyond said round base from diametrically opposed positions about said round base, said first extension having a plurality of strips attached thereto for forming a first plurality of loops therealong;

a second strap attached to said round base and crossing said first strap at a central portion of said round base, said second strap having a third extension and a fourth extension extending beyond said round base from diametrically opposed positions about said round base, said third extension having a plurality of strips attached thereto for forming a second plurality of loops therealong, said fourth extension having a plurality of strips attached thereto for forming a third plurality of loops therealong;

a third strap attached to said round base and crossing said first strap and said second strap at said central portion of said round base, said third strap having a fifth extension and a sixth extension extending beyond said round base from diametrically opposed positions about said round base, said fifth extension having a plurality of strips attached thereto for forming a fourth plurality of loops therealong, said sixth extension having a plurality of strips attached thereto for forming a fifth plurality of loops therealong;

a plurality of tightening straps for forming a corresponding plurality of adjustable circumference loops, each of said plurality of tightening straps attached perpendicular to said second extension of said first strap and passing through one each of said first plurality of loops, said second plurality of loops, said third plurality of loops, said fourth plurality of loops and said fifth plurality of loops; and each of said first strap, said second strap and said third strap terminating at each end thereof in a hoisting loop, wherein said hoisting loops are used to lift said carrier.

11. A carrier as in claim 10 wherein said first strap, said second strap and said third strap cross one another to define equi-angular spacing therebetween.

12. A carrier as in claim 10 wherein said first plurality of loops, said second plurality of loops, said third plurality of loops, said fourth plurality of loops and said fifth plurality of loops are aligned to define a corresponding plurality of loop arrangements, each of said plurality of loop arrangements cooperating with one of said plurality of tightening straps.

13. A carrier as in claim 10 wherein said first plurality of loops, said second plurality of loops, said third plurality of loops, said fourth plurality of loops and said fifth plurality of loops are positioned such that said plurality of tightening straps are substantially parallel to one another.

14. A carrier as in claim 10 wherein said round base is flexible.

15. A carrier comprising:

a round base made from woven nylon webbing;

a first strap made from woven nylon webbing attached to said round base and having a first extension and a second extension extending beyond said round base from diametrically opposed positions about said round base, said first extension having a plurality of strips made from woven nylon webbing attached thereto for forming a first plurality of loops therealong;

a second strap made from woven nylon webbing attached to said round base and crossing said first strap at a central portion of said round base, said second strap having a third extension and a fourth extension extending beyond said round base from diametrically opposed positions about said round base, said third extension having a plurality of strips made from woven nylon webbing attached thereto for forming a second plurality of loops therealong, said fourth extension having a plurality of strips made from woven nylon webbing attached thereto for forming a third plurality of loops therealong;

a third strap made from woven nylon webbing attached to said round base and crossing said first strap and said second strap at said central portion of said round base, said third strap having a fifth extension and a sixth extension extending beyond said round base from diametrically opposed positions about said round base, said fifth extension having a plurality of strips made from woven nylon webbing attached thereto for forming a fourth plurality of loops therealong, said sixth extension having a plurality of strips made from woven nylon webbing attached thereto for forming a fifth plurality of loops therealong;

a plurality of tightening straps made from woven nylon webbing for forming a corresponding plurality of adjustable circumference loops, each of said plurality of tightening straps attached perpendicular to said second extension of said first strap and passing through one each of said first plurality of loops, said second plurality of loops, said third plurality of loops, said fourth plurality of loops and said fifth plurality of loops; and each of said first strap, said second strap and said third strap terminating at each end thereof in a hoisting loop, wherein said hoisting loops are used to lift said carrier.

16. A carrier as in claim 15 wherein said first strap, said second strap and said third strap cross one another to define equi-angular spacing therebetween.

17. A carrier as in claim 15 wherein said first plurality of loops, said second plurality of loops, said third plurality of loops, said fourth plurality of loops and said fifth plurality of loops are aligned to define a corresponding plurality of loop arrangements, each of said plurality of loop arrangements cooperating with one of said plurality of tightening straps.

18. A carrier as in claim 15 wherein said first plurality of loops, said second plurality of loops, said third plurality of loops, said fourth plurality of loops and said fifth plurality of loops are positioned such that said plurality of tightening straps are substantially parallel to one another.

* * * * *